US005947318A

United States Patent [19]

Palm

[11] Patent Number: 5,947,318

[45] Date of Patent: Sep. 7, 1999

[54] OPENING DEVICE FOR PACKAGES OF POURABLE FOOD PRODUCTS

[75] Inventor: Lars Erik Palm, Lund, Sweden

[73] Assignee: Tetra Laval Holdings & Finance S.A., Pully, Switzerland

[21] Appl. No.: 09/018,555

[22] Filed: Feb. 4, 1998

[30] Foreign Application Priority Data

Feb. 24, 1997 [IT] Italy ..... MI97A0389

[51] Int. Cl.[6] ..... B65D 17/44; B67D 5/00

[52] U.S. Cl. ..... 220/278; 220/297; 222/83; 222/541.2

[58] Field of Search ..... 220/277, 278, 220/258, 293, 298, 297, 300; 215/250, 257, 332, 357, 48; 229/125.15, 125.17, 125.04; 222/81, 83, 83.5, 88, 87, 541.2, 541.8

[56] References Cited

U.S. PATENT DOCUMENTS

| | | |
|---|---|---|
| D. 377,145 | 1/1997 | Huser . |
| 3,251,499 | 5/1966 | Rausing et al. . |
| 3,348,719 | 10/1967 | Rausing et al. . |
| 3,935,968 | 2/1976 | Rausing . |
| 3,999,678 | 12/1976 | Ignell et al. . |
| 4,078,688 | 3/1978 | Nilsson et al. . |
| 4,109,814 | 8/1978 | Rausing . |
| 4,140,235 | 2/1979 | Rausing et al. . |
| 4,387,820 | 6/1983 | Ignell . |
| 5,248,054 | 9/1993 | Berggren et al. . |
| 5,255,813 | 10/1993 | Berggren et al. . |

*Primary Examiner*—Stephen K. Cronin
*Assistant Examiner*—Nathan Newhouse
*Attorney, Agent, or Firm*—Burns, Doane, Swecker & Mathis, L.L.P.

[57] ABSTRACT

The opening device (1) for packages of pourable food products has a frame (3) connectable to a package, and a sleeve-like portion (10) defined by the frame (3) and having a circular aperture (12) provided therein. A cap (2) releasably engages the sleeve-like portion in a liquid-tight relationship therewith. A cylindrical portion (7) defined by the cap (2) is rotatably accommodatable inside the circular aperture (12), and cutting teeth (17) are connected to the cylindrical portion (7) for cutting packaging material located beneath the circular aperture (12), whereby to open a package. Cam-followers (23*a*–23*c*) connected to an inner annular wall (13) of the sleeve-like portion (10) slidebly engage cam-defining contoured slots (22*a*–22*c*) formed on the cylindrical portion, for converting unidirectional rotation of the cap (2) with respect to said frame (3), into bi-directional axial movement of the cylindrical portion with respect to the sleeve-like portion.

19 Claims, 4 Drawing Sheets

Fig. 11
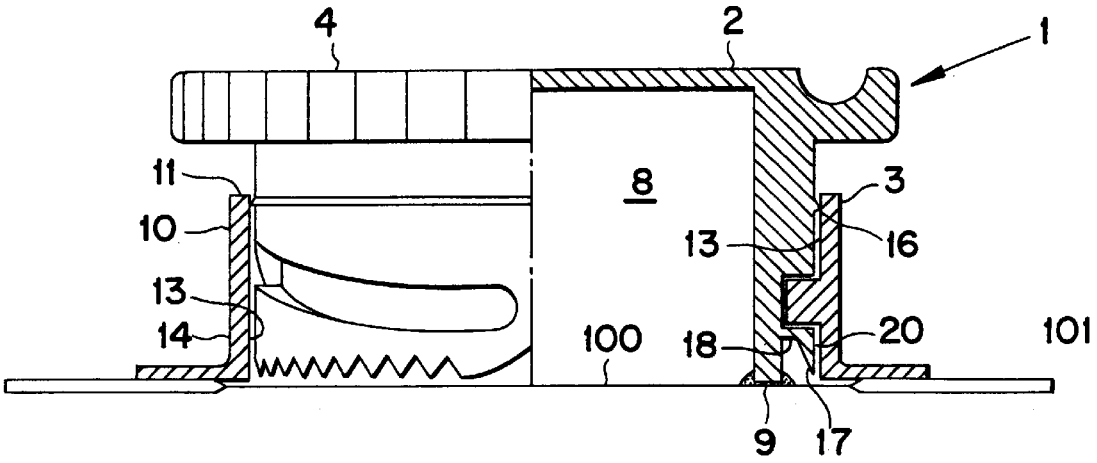
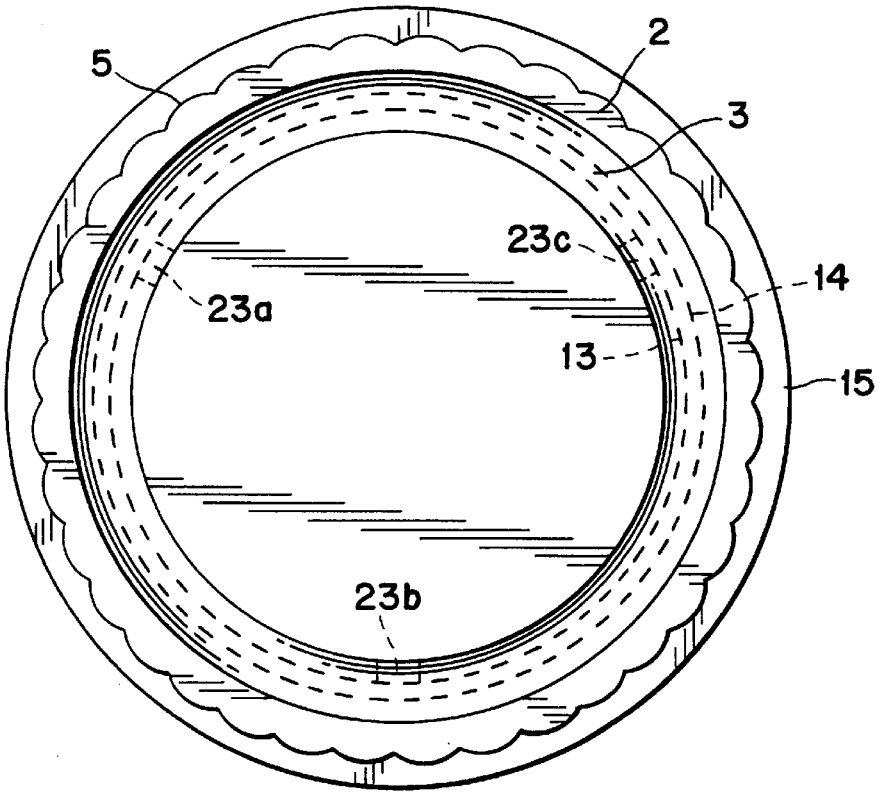
Fig. 12

OPENING DEVICE FOR PACKAGES OF POURABLE FOOD PRODUCTS

This application claims priority under 35 U.S.C. §§119 and/or 365 to No. MI97A 00389 filed in Italy on Feb. 24, 1997.

TECHNICAL FIELD

The present invention relates to an opening device for packages containing a pourable or flowable food product. The opening device is particularly suitable for use on aseptic packages containing sterile-treated food product such as fruit juice, heat-treated milk which is subjected to so-called UHT (ultra high temperature) treatment etc., and may be also used for packages containing pasteurised food products such as pasteurised milk.

BACKGROUND ART

Many commercially available food products, including sterile-treated fruit juice, wine, UHT milk, tomato puree etc., are packed in packages which are manufactured from a previously sterilized or sterile-treated packaging material. A typical example of this kind of package is the parallelepipedal packaging container for liquid or pourable food products, which is known by the name Tetra Brik Aseptic (Registered Trade Mark), which is manufactured by folding and sealing of a web-shaped laminated packaging material. The laminated packaging material comprises layers of fibrous material such as paper, which are coated on either side with a thermoplastic material such as polyethylene. On the side of the laminated packaging material which is destined to be in contact with the food contents of the package, there is also a layer of barrier material, such as e.g., aluminium foil, which is also coated with a thermoplastic layer.

In order to manufacture parallelepipedal packaging containers of this type, filling or packaging machines are fed with laminated packaging material in web form. The packaging material web is sterilized in the packaging machine by the application of a chemical sterilization agent such as e.g., hydrogen peroxide solution. Upon completion of sterilization, the sterilization agent is removed from the surfaces of the packaging material, for example, it may be vaporized by heating. The thus sterilized packaging material web is retained in a closed sterile space and is folded and longitudinally sealed to form a tube. The tube is filled with sterile-treated food product and is transversely sealed and cut into pillow-shaped, filled and sealed packaging containers, which are then mechanically folded to form a parallelepipedal package.

In order to open this type of package, several solutions have been proposed. One solution consisted in the provision of a line of perforations, partially penetrating the outer layers of the laminated packaging material but leaving the internal barrier layer or layers intact, and extending across the corner zone of a flap of the package. By raising the flap and cutting or tearing along the perforations, the package was opened, and the contents could be poured from the package. However, the package could not be reclosed, and thus had to be handled in a careful manner to avoid spillage, until all of the contents were used.

In order to overcome this inconvenience, various types of reclosable opening devices have been proposed. One such solution consisted in the provision of an outlet opening formed in the packaging material laminate and a pull-tab applied over the opening in the filling or packaging machine, with a frame-like pouring device having a reclosable lid connected to the outside of the filled and formed package over the pull-tab. In order to access the contents of the package, a user must first open the lid, and then remove the pull-tab. Once the desired quantity of contents has been removed from the package, the lid can be reclosed.

While this solution is extremely advantageous from many standpoints, it has been found to be susceptible to improvement. Specifically, it would be desirable to have an opening device which permits a user to open the above-described type of package in a single operation, and thereafter provide the possibility of package reclosure with improved liquid-tightness.

Laid-open Japanese Patent No. 63-149818 describes an opening device used for packages of the gable-top type, which are usually formed from a packaging material blank on a mandrel and are particularly suitable for pasteurised food products. The opening device has a frame affixed to one of the two inclined walls of the gable-top package and bearing two upright sem-icircular walls. A lever having a matching semi-circular configuration is journalled between the walls for rotation about an axis passing substantially through the centres of the planar bases of the semi-circular walls, parallel and adjacent to the surface of the package. The lower portion of the lever facing the package has teeth for rupturing the packaging material, and a grip-tab, whereby a user can open the package by rotating the lever in one direction, and reclose the package by rotating the lever in the opposite direction.

However, this kind of opening device requires the application of significant force in order to drive the teeth through the packaging material. This may lead to inadvertent spillage of the contents of the package. Furthermore, the excessive force exerted on the points whereat the lever is journalled to the walls, may cause damage to or even breakage of the device. Moreover, although the device can be reclosed after opening, the reclosure is not liquid-tight, whereby spillage may occur in the event that a reclosed container is accidentally knocked over.

A screw cap provides a better degree of liquid-tightness when reclosed, but when using a screw cap on an aseptic package of the above-described type, some provision has to be made for rupturing the barrier layer of the container at the time of opening, so as to maintain the aseptic quality of the package, right up to the moment when the package is opened for consumption of the product contained therein.

Known from laid-open Japanese Patent Application No. 63-156928 is a three-piece opening device consisting of a frame having an externally threaded portion, a screw-cap which can be screwed onto the frame, and a sleeve located in a tubular portion of the frame and having a lower toothed edge which, when actuated by screwing the cap onto the frame, perforates the laminated packaging material of a container. However, this device has the sleeve part in addition to the cap and frame, and is therefore more expensive to manufacture and assemble with respect to traditional screw caps. Furthermore, the cutting action of the toothed edge can cause severed fragments of packaging material to fall by gravity into the underlying food product contained in the package.

Laid-open Japanese Patent Application No. 64-2727 describes an opening device, for the above-mentioned gable-top type of package. This latter device has a frame defining a tubular portion, a sleeve arranged slideably within the tubular portion and connected to the frame by a collapsible bellows, and a cap hinged to the frame and overlying the open uppermost end of the sleeve in a closed position. A user has to apply pressure on the cap, which is transferred to the sleeve, thereby collapsing the bellows. The lower end of the sleeve punctures the packaging material of the container and the reclosable cap can be opened to pour the contents.

However, the cap can be knocked during handling and transportation, thereby inadvertently collapsing the bellows and causing the sleeve to puncture the underlying packaging material. Furthermore, the perforating action of the sleeve can cause severed fragments of packaging material to fall by gravity into the underlying food product contained in the package.

OBJECTS OF THE INVENTION

There is a general need in the art to provide an improved opening device for packages of flowable or pourable food products of the above-mentioned type, which facilitates opening and has improved liquid-tight reclosure sealing.

One object of the present invention is therefore to provide an opening device for packages containing a pourable or flowable food product which can be opened in one single operation.

Another object of the invention is to provide an opening device for packages containing a pourable or flowable food product which provides a liquid-tight reclosure of the package after opening.

A further object of the invention is to provide an opening device for packages containing a pourable or flowable food product which can be easily opened by a user without requiring significant force to be applied, whereby spillage of the contents of a package during opening is avoided.

Yet another object of the invention is to provide an opening device having means for automatically rupturing the barrier layer of an aseptic package at the time of opening the package.

A further object of the invention is to provide an opening device wherein the means for rupturing the barrier layer of an aseptic package at the time of opening cannot be inadvertently actuated during handling and transportation, thereby maintaining the aseptic quality of the package right up to the moment when the package is opened for consumption of the product contained therein.

Another object of the invention is to provide an opening device for packages containing a pourable or flowable food product, wherein the means for rupturing the barrier layer of an aseptic package can be utilised in such a manner as to prevent severed fragments of packaging material from falling by gravity into the underlying food product contained in the package.

DISCLOSURE OF THE INVENTION

With the above objects in view, as well as other objects of the invention which will become apparent hereinafter, there is provided an opening device for packages of pourable food products comprising a frame connectable to a package, a sleeve-like portion defined by said frame and having a circular aperture provided therein, a cap having a cylindrical portion cap rotatably accommodatable inside said circular aperture releasably and engaging said sleeve-like portion in liquid-tight relationship therewith, and cutting means connected to a lower edge of said cylindrical portion for cutting packaging material located beneath said circular aperture whereby to open a package, characterised in that it comprises means for converting unidirectional rotation of said cap with respect to said frame, into bi-directional axial movement of said cylindrical portion with respect to said sleeve-like portion.

Preferred embodiments of the opening device according to the invention are defined in the appended sub-claims.

BRIEF DESCRIPTION OF THE DRAWINGS.

FIG. 11 is a partly sectional front elevational view of the opening device of FIG. 1, in an assembled and closed condition; and FIG. 12 is a top plan view of the opening device of FIG. 11.

Figure 1:
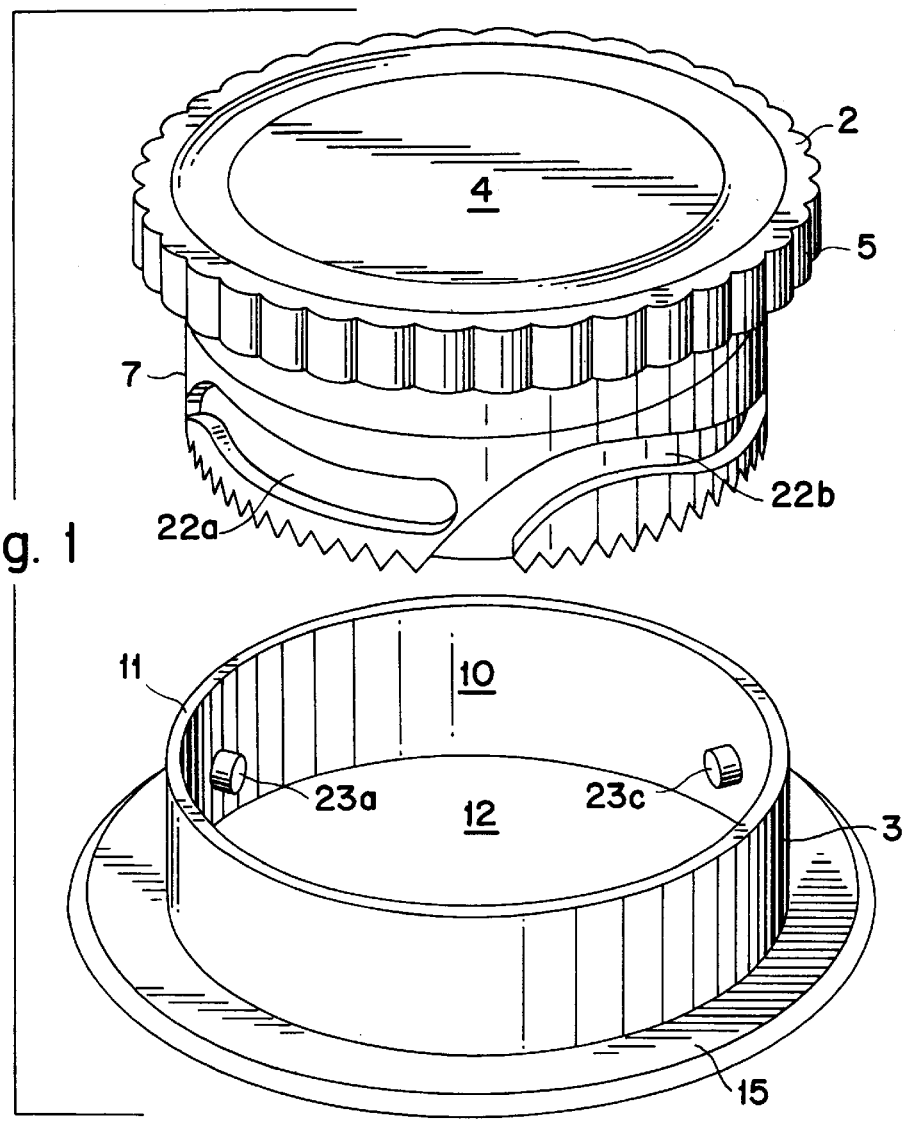
FIG. 1 is an exploded perspective view showing the frame and the cap of the closure device according to the invention.
Figure 2:
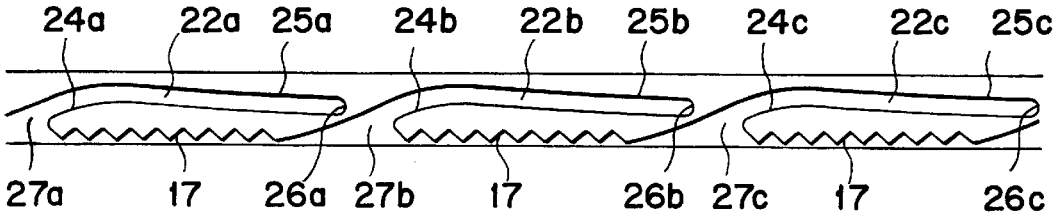
FIG. 2 is a developed fragmentary view of slots defining cams on a cylindrical portion of the cap of FIG. 1.

DESCRIPTION OF THE PREFERRED EMBODIMENTS.

With reference to the above-described drawing figures, the opening device 1 for packages of pourable food products according to the invention has a cap 2 and a frame 3. The cap 2 defines a lid portion having an upper surface 4, an edge 5 extending substantially perpendicularly from the upper surface and preferably having a knurled or ribbed edge configuration for facilitating gripping by a user, and a lower surface 6 parallel to the upper surface 4. The lower surface 6 circumscribes a cylindrical portion 7. The cylindrical portion 7 extends perpendicularly from the lower surface 6 and preferably has a hollow portion 8 and an annular bottom edge 9. The bottom edge 9 can, in practice, be affixed to a weakened portion of a package. The weakened portion may be formed, e.g., by a layer of barrier material of an aseptic package which is accessible through a cut-out formed in a superimposed layer of fibrous material of such package, in a conventional manner.

The frame 3 has a sleeve-like portion 10 defining an upper annular edge 11 extending, in use, parallel to the lower surface 6 of the lid portion of the cap 2. The sleeve-like portion 10 circumscribes a circular aperture 12 and defines an inner annular wall 13, having an internal diameter which substantially corresponds to or is slightly larger than the external diameter of the cylindrical portion 7 of the cap 2, and an outer annular wall 14 extending parallel to the inner annular wall 13. The frame 3 preferably has a radially protruding rib 15 formed integrally with the sleeve-like portion 10 and circumscribing the outer annular wall 14. The rib can be affixed to the packaging material 101 of a package at a location thereon surrounding the weakened portion 100.

In practice, the bottom edge 9 can be fixed to the weakened portion 100 and the rib 15 can be fixed to the packaging material 101 surrounding the weakened portion 100 by means of, e.g., hot-melt adhesive, welding techniques including microflame welding, or in any convenient manner according to specific manufacturing requirements.

The cylindrical portion 7 of the cap 2 is, in use, accommodated within the sleeve-like portion 10 of the frame 3. The cylindrical portion 7 and the sleeve-like portion 10 are rotatable relative to each other. Advantageously, sealing means are provided between the cylindrical portion 7 and the sleeve-like portion 10. The sealing means are preferably constituted by a at least one sealing lip 16 (see FIG. 11), which is formed integrally with the cylindrical portion 7 of the cap 2 and contacts the inner annular wall 13 of the sleeve-like portion 10, in liquid-tight sliding abutment engagement therewith. One skilled in the art will recognise that the sealing lip 16 may alternatively be provided integrally with the inner annular wall of the sleeve-like portion and sealingly and slideably engage the cylindrical portion of the cap 2, and thus, that the location and number of sealing lips may be determined according to specific manufacturing requirements.

The opening device 1 has cutting means connected to the cylindrical portion 7, for cutting packaging material, such as the weakened portion 100 of packaging material, lying beneath the circular aperture 12. The cutting means are preferably constituted by an annular array of cutting teeth 17. The circumference of the annular array of cutting teeth 17 corresponds to the circumference of the cylindrical portion. The annular array of cutting teeth 17 are located proximate to the bottom edge 9 of the cylindrical portion and arranged concentrically with respect thereto. A spacer 18 extends radially between the cylindrical portion 7 and the annular array of cutting teeth 17, parallel to a plane containing the bottom edge 9. The cutting teeth 17 each have an apex 19, an outer tooth surface 20 located flush with an external wall of said cylindrical portion 7, and an inclined inner tooth surface 21 extending between said apex 19 and said spacer 18.

According to the invention, the opening device also has means 22 for converting unidirectional rotation of said cap 2 with respect to said frame 3, into bi-directional axial movement of said cylindrical portion 7 with respect to said sleeve-like portion 10. The means 22 comprise cams 22*a*, 22*b*, 22*c*, and cam-followers 23*a*, 23*b*, 23*c*, acting between the sleeve-like portion 10 and the cylindrical portion 7. In the preferred embodiment of the invention, the cams 22*a*–22*c* are connected to the cylindrical portion 7 of the cap 2, and are preferably formed integrally therewith, while the cam followers 23*a*–23*c* are connected to said sleeve-like portion 10 of said frame are preferably formed integrally therewith. However, it will be appreciated by one skilled in the art that the cam followers could be provided on the cylindrical portion of the cap and the cams could be formed on the sleeve-like portion of the frame 3, without thereby departing from the purview of the present invention.

The cams 22*a*–22*c* are constituted by contoured slots formed in an external annular wall of the cylindrical portion 7 of the cap 2 and slideably accommodate the cam-followers 23*a*–23*c*, defined by radially protruding pins connected to the inner annular wall 13 of the sleeve-like portion and preferably formed integrally therewith. The contoured slots each define an ascending cam portion 24*a*,24*b*,24*c*, a descending cam portion 25*a*,25*b*,25*c*, and a closed end 26*a*,26*b*,26*c* defining an end stop position for a respective one of said cam followers 23*a*–23*c* corresponding to a fully closed position of the cap 2. The contoured slots also each having an open end 27*a*,27*b*,27*c*, for allowing disengagement of said cylindrical portion 7 from said cam-followers 23*a*–23*c*, whereby to permit removal of the cap 2, from the frame. It will be noted that a descending cam portion 25*a*–25*c* is located proximate to the closed end 26*a*–26*c* of each respective contoured slot, and also it will be noted that an ascending cam portion 24*a*–24*c* is located proximate to the open end 27*a*–27*c* of each respective contoured slot.

As can be seen in the drawing figures, the open ends 27*a*–27*c* of the cams or contoured slots 22*a*–22*c* intersect the circumference of the annular array of cutting teeth 17 at angularly spaced intervals. In the illustrated preferred embodiment of the invention, three pins 23*a*–23*c* are connected to the sleeve-like portion and slideably engaging at least three respective contoured slots 22*a*–22*c* formed in the cylindrical portion of the cap 2, and the circumference of the annular array of cutting teeth 17 is intersected in three points by the open ends 27*a*–27*c* of the contoured slots. The three pins are angularly spaced apart by 120 degrees around the internal annular wall of said sleeve-like portion. However, it will be appreciated that the number of cams and cam followers may be varied according to requirements.

Figure 4:
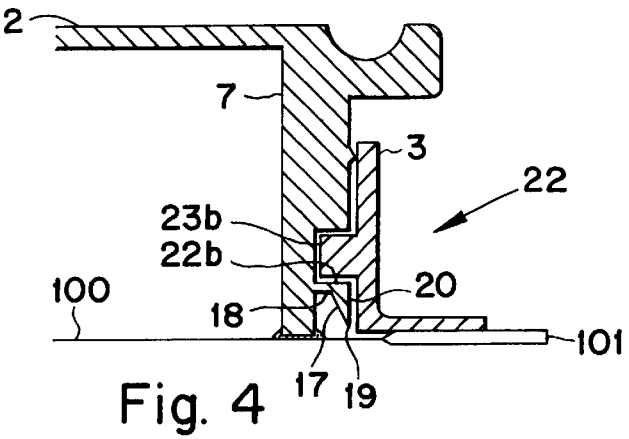
FIG. 4 is an enlarged sectional detail view of the closure device of FIG. 3, showing the position of a cutting tooth with respect to a layer of barrier material of one type of package on which the closure device may be applied.
Figure 3:
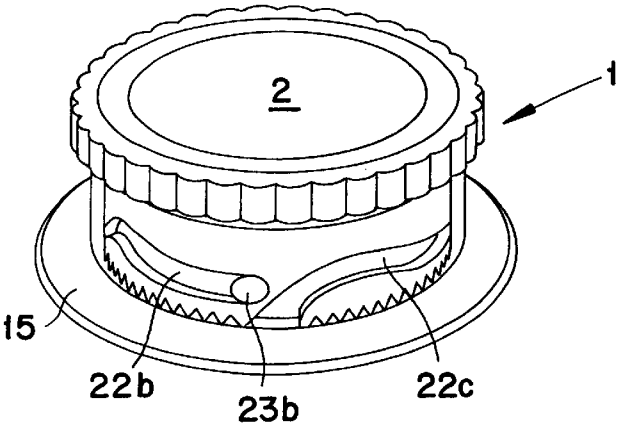
FIG. 3 is a perspective view of the closure device according to the invention in a closed condition, with a cut-away portion showing the relative positions of cams and cam followers.

The operation of the opening device according to the invention is the following:

The cap 2 and the frame 3 are manufactured and assembled such that the cam followers 23*a*–23*c* engage the closed ends 26*a*–26*c* of the contoured slots 22*a*–22*c* (see FIGS. 3 and 4). The bottom edge 9 of the cap 2 is then affixed in any convenient manner to a weakened portion 100 of a package, while the annular rib 15 of the frame 3 is affixed, in any convenient manner, to packaging material 101 surrounding the weakened portion 100.

Figure 6:
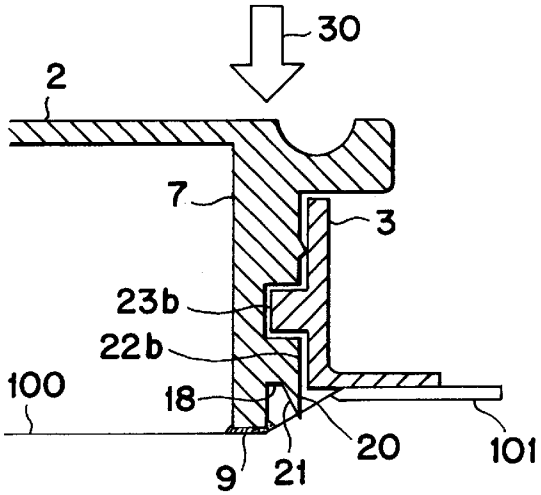
FIG. 6 is an enlarged sectional detail view of the closure device of FIG. 4, showing the cutting tooth penetrating the layer of barrier material.
Figure 5:
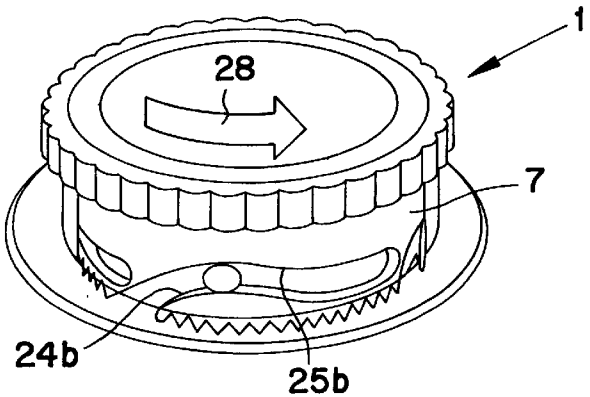
FIG. 5 is a perspective view of the closure device similar to FIG. 3, showing the device in a partially open position and with a cut-away portion showing the relative positions of the cams and cam followers.
Figure 8:
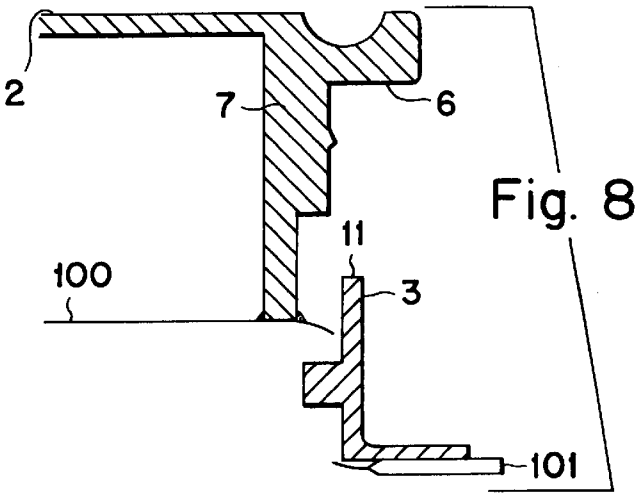
FIG. 8 is an enlarged sectional detail view of the closure device of FIG. 7, showing the a cam-follower located at an open end of a cam-defining slot.
Figure 10:
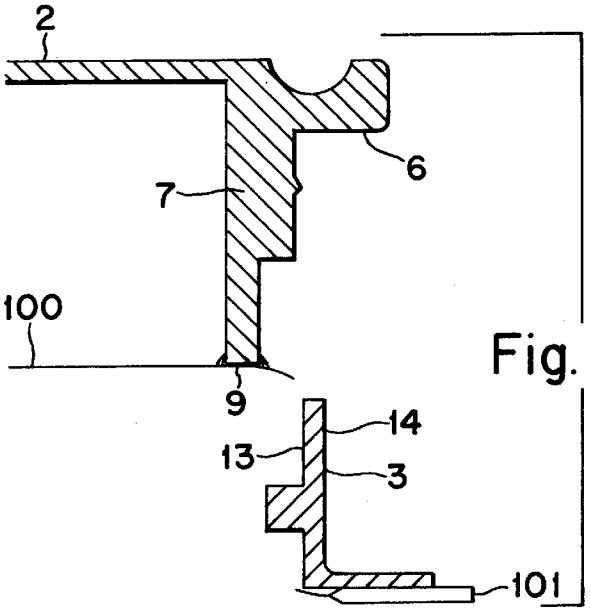
FIG. 10 is an enlarged sectional detail view of the closure device of FIG. 9.

A user of the opening device grips the cap 2 and rotates it with respect to the frame 3 in an anticlockwise direction as indicated by the reference numeral 28 in FIG. 5. This causes rotation of the cylindrical portion 7 with respect to the sleeve-like portion 10. Since the bottom edge 9 is affixed to the weakened portion 100 and the rib 15 is affixed to the packaging material 101 surrounding the weakened portion 100, the rotational forces imparted by a user on the cap 2 are transmitted to the weakened portion 100. The weakened portion is thus mechanically deformed and possibly also slightly stretched, according to the material constituting the weakened portion of the packaging material, and a condition of pre-tensioning of the weakened portion 100 occurs. Simultaneously, the cam followers 23*a*–23*c* travel along the descending portions 25*a*–25*c* of the cams defined by the contoured slots 22*a*–22*c*, thereby causing the cylindrical portion 7 to travel axially downwards, in a first direction indicated by the arrow 30 in FIG. 6. This forces the annular array of teeth 17 downwards into engagement with the pre-tensioned weakened portion 100 of packaging material. The teeth 17 then easily penetrate the pre-tensioned weakened portion 100 of packaging material (see FIGS. 5 and 6), which is thus severed along the circumference of the annular array of teeth 17. At this point, it should be noted that by virtue of the significant mechanical advantage afforded by the cam arrangement, only a relatively small opening force need be applied by a user in order to affect this first step of severing the weakened portion 100 from the surrounding packaging material 101.

Figure 7:
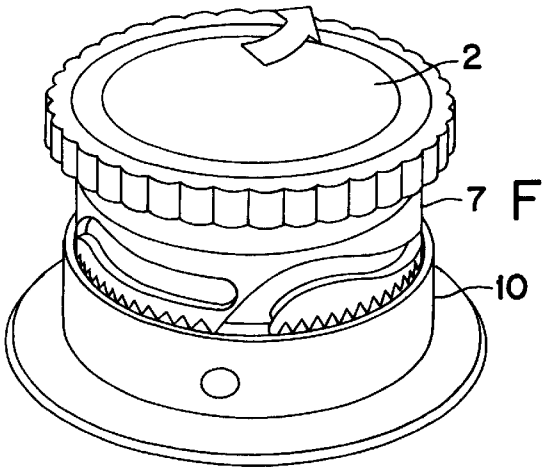
FIG. 7 is a perspective view of the closure device similar to FIG. 3, showing the device in an open position.
Figure 9:
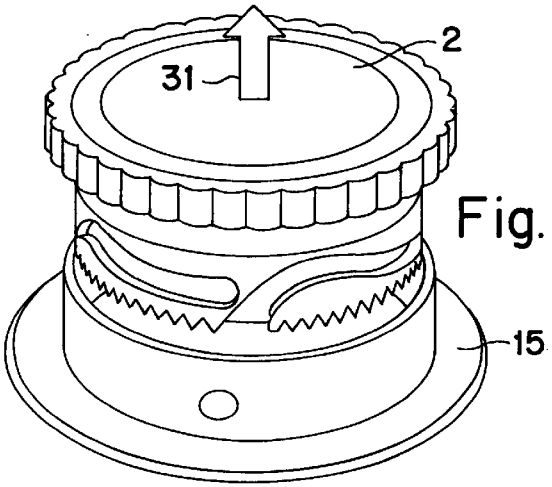
FIG. 9 is a perspective view of the closure device similar to FIG. 3, showing the removal of the cap from the frame for opening a package.

Thereafter, by continuing to rotate the cap 2 in the same direction as that indicated by the arrow 28 in FIG. 5, the cam followers 23*a*–23*c* travel along the ascending portions 24*a*–24*c* of the cams defined by the contoured slots 22*a*–22*c*, thereby causing the cylindrical portion 7 to travel axially upwards, in a second direction indicated by the arrow 31 in FIG. 7. This, causes the entire cap 2 to move upwards, with the severed weakened portion 100 attached to the bottom edge 9 of the cylindrical portion 7, thereby avoiding any packaging material debris from falling into the underlying contents of the package. Further rotation of the cap 2 in the same direction brings the open ends 27*a*–27*c* of the contoured slots 22*a*–22*c* into alignment with the cam followers, 23*a*–23*c*, and the cap 2 can be removed from the frame (see FIGS. 7–10).

The opening device is easily reclosed by aligning the open ends 27*a*–27*c* of the contoured slots 22*a*–22*c* with the cam followers 23*a*–23*c*, and rotating the cap in an opposite direction with respect to that indicated by the arrow 28 in FIG. 5.

The invention as described herein may be modified without departing from the scope of the amended claims.

I claim:

1. An opening device for packages of pourable food products comprising:

a frame connectable to a package, said frame including a sleeve portion having a circular aperture in said sleeve portion;

a cap having a cylindrical portion sized to be rotatably received inside said sleeve portion circular aperture and to engage said sleeve portion in liquid-tight relationship therewith, said cylindrical portion having a lower edge;

cutting means connected to said lower edge for cutting packaging material located beneath said circular aperture when said opening device is mounted on a package to open said package and means for converting unidirectional rotation of said cap with respect to said frame into bidirectional axial movement of said cylindrical portion with respect to said sleeve portion.

2. A package for pourable food products, comprising:

a package; and an opening device according to claim 1.

3. A package for pourable food products comprising:

a package; and an opening device according to claim 1;

wherein said packages comprises a reduced thickness portion, said frame being connected to said package and circumscribing said reduced thickness portion, said lower edge of said cylindrical portion being connected to said reduced thickness portion.

4. A package according to claim 3, wherein said reduced thickness portion connected to said lower edge comprises an aseptic barrier layer of said package.

5. An opening device according to claim 1, wherein said means for converting unidirectional rotation of said cap with respect to said frame into bidirectional axial movement of said cylindrical portion with respect to said sleeve portion comprises cams and cam-followers acting between said sleeve portion and said cylindrical portion.

6. An opening device according to claims 5, wherein said cams each comprise at least one ascending cam portion and at least one descending cam portion.

7. An opening device according to claim 5, wherein said cams are connected to said cylindrical portion of said cap, and said cam followers are connected to said sleeve portion of said frame.

8. An opening device according to claim 5, wherein said cap cylindrical portion includes an external annular wall, and said cams comprise contoured slots formed in said external annular wall, which contoured slots slideably receive said cam-followers.

9. An opening device according to claim 8, wherein said contoured slots each comprise a closed end defining an end stop position for a respective one of said cam followers corresponding to a fully closed position of said cap, said contoured slots also each comprising an open end for disengagement of said cylindrical portion from said cam-followers to permit removal of said cap from said frame.

10. An opening device according to claim 9, wherein said cutting means comprises an annular array of cutting teeth defining a circumference, said open ends of said contoured slots intersecting said circumference of said annular array of cutting teeth at angularly spaced intervals.

11. An opening device according to claim 5, wherein said sleeve portion comprises an inner annular wall, and said cam-followers each comprise a radially protruding pin connected to said inner annular wall.

12. An opening device according to claim 11, wherein said pins are formed integrally with said sleeve portion.

13. An opening device according to claim 11, comprising at least three pins connected to said sleeve inner annular wall and at least three slots formed in said cylindrical portion, each slot slidably engaging one of said at least three pins and having an open end, said cutting means being intersected in at least three points by said open ends of said at least three slots.

14. An opening device according to claim 13, wherein said at least three pins are angularly spaced apart by 120 degrees around said internal annular wall of said sleeve portion.

15. An opening device for packages of pourable food products comprising:

a frame connectable to a package, said frame including a sleeve portion having a circular aperture in said sleeve portion;

a cap having a cylindrical portion sized to be rotatable received inside said sleeve portion circular aperture and to engage said sleeve portion in liquid-tight relationship therewith;

cutting means connected to a lower edge of said cylindrical portion for cutting packaging material located beneath said circular aperture when said opening device is mounted on a package to open said package;

means for converting unidirectional rotation of said cap with respect to said frame into bidirectional axial movement of said cylindrical portion with respect to said sleeve portion;

wherein said means for converting unidirectional rotation of said cap with respect to said frame into bidirectional axial movement of said cylindrical portion with respect to said sleeve portion comprises cams and cam-followers acting between said sleeve portion and said cylindrical portion;

wherein said cap cylindrical portion includes an external annular wall, and said cams comprise contoured slots formed in said external annular wall, which contoured slots slideably receive said cam-followers;

wherein said contoured slots each comprise a closed end defining an end stop position for a respective one of said cam followers corresponding to a fully closed position of said cap, said contoured slots also each comprising an open end for disengagement of said cylindrical portion from said cam-followers to permit removal of said cap from said frame;

wherein said cutting means comprises an annular array of cutting teeth defining a circumference, said open ends of said contoured slots intersecting said circumference of said annular array of cutting teeth at angularly spaced intervals; and wherein said cylindrical portion lower edge comprises an abutment member fixable to a weakened portion of a package, said annular array of cutting teeth being located proximate to said lower edge and arranged concentrically with respect to said abutment member.

16. An opening device according to claim 15, wherein said cylindrical portion defines a spacer formed integrally therewith and extending radially between said abutment member and said annular array of cutting teeth.

17. An opening device according to claim 16, wherein said cutting teeth each have an apex, an outer tooth surface located flush with an external wall of said cylindrical portion, and an inclined inner tooth surface extending between said apex and said spacer.

18. An opening device for packages of pourable food products comprising:

a frame connectable to a package, said frame including a sleeve portion having a circular aperture in said sleeve portion;

a cap having a cylindrical portion sized to be rotatably received inside said sleeve portion circular aperture and to engage said sleeve portion in liquid-tight relationship therewith;

cutting means connected to a lower edge of said cylindrical portion for cutting packaging material located beneath said circular aperture when said opening device is mounted on a package to open said package;

means for converting unidirectional rotation of said cap with respect to said frame into bidirectional axial movement of said cylindrical portion with respect to said sleeve portion;

wherein said means for converting unidirectional rotation of said cap with respect to said frame into bidirectional axial movement of said cylindrical portion with respect to said sleeve portion comprises cams and cam-followers acting between said sleeve portion and said cylindrical portion;

wherein said cap cylindrical portion includes an external annular wall, and said cams comprise contoured slots formed in said external annular wall, which contoured slots slideably receive said cam-followers; and wherein said contoured slots each define at least one ascending cam portion and at least one descending cam portion.

19. An opening device for packages of pourable food products comprising:

a frame connectable to a package, said frame including a sleeve portion having a circular aperture in said sleeve portion;

a cap having a cylindrical portion sized to be rotatably received inside said sleeve portion circular aperture and to engage said sleeve portion in liguid-tight relationship therewith;

cutting means connected to a lower edge of said cylindrical portion for cutting packaging material located beneath said circular aperture when said opening device is mounted on a package to open said package;

means for converting unidirectional rotation of said cap with respect to said frame into bidirectional axial movement of said cylindrical portion with respect to said sleeve portion;

wherein said means for converting unidirectional rotation of said cap with respect to said frame into bidirectional axial movement of said cylindrical portion with respect to said sleeve portion comprises cams and cam-followers acting between said sleeve portion and said cylindrical portion:

wherein said cap cylindrical portion includes an external annular wall, and said cams comprise contoured slots formed in said external annular wall, which contoured slots slideably receive said cam-followers;

wherein said contoured slots each comprise a closed end defining an end stop position for a respective one of said cam followers corresponding to a fully closed position of said cap, said contoured slots also each comprising an open end for disengagement of said cylindrical portion from said cam-followers to permit removal of said cap from said frame; and wherein a descending cam portion is located proximate to said closed end of each contoured slot, and wherein an ascending cam portion is located proximate to said open end of each contoured slot.

* * * * *